US010499708B2

(12) United States Patent
You

(10) Patent No.: US 10,499,708 B2
(45) Date of Patent: Dec. 10, 2019

(54) EYELET MEMBER AND METHOD OF MANUFACTURING THE SAME

(71) Applicant: Seoung-Min You, Seoul (KR)

(72) Inventor: Seoung-Min You, Seoul (KR)

( * ) Notice: Subject to any disclaimer, the term of this patent is extended or adjusted under 35 U.S.C. 154(b) by 79 days.

(21) Appl. No.: 15/565,417

(22) PCT Filed: Apr. 7, 2016

(86) PCT No.: PCT/KR2016/003643
§ 371 (c)(1),
(2) Date: Oct. 9, 2017

(87) PCT Pub. No.: WO2016/171416
PCT Pub. Date: Oct. 27, 2016

(65) Prior Publication Data

US 2018/0125167 A1 May 10, 2018

(30) Foreign Application Priority Data

Apr. 23, 2015 (KR) ..... 10-2015-0057500
Jun. 25, 2015 (KR) ..... 10-2015-0090689

(51) Int. Cl.
*A44B 17/00* (2006.01)
*A43C 5/00* (2006.01)
(Continued)

(52) U.S. Cl.
CPC ..... *A43C 5/00* (2013.01); *A44B 13/0076* (2013.01); *A45C 13/001* (2013.01); *A45C 13/08* (2013.01);
(Continued)

(58) Field of Classification Search
CPC ..... A43C 5/00; A44B 13/0076; A45C 13/001; A45C 13/08; A45C 13/10; A45C 13/1076
See application file for complete search history.

(56) References Cited

U.S. PATENT DOCUMENTS 1,782,164 A * 11/1930 Ford ..... A44B 17/0017 24/691
1,831,202 A * 11/1931 Simons ..... A44B 17/0082 24/671
(Continued)

FOREIGN PATENT DOCUMENTS

KR 20-1987-0001690 Y1 5/1987
KR 20-1987-0001691 Y1 5/1987
(Continued)

OTHER PUBLICATIONS

International Search Report for PCT/KR2016/003643 dated Sep. 30, 2015 from Korean Intellectual Property Office.

*Primary Examiner* — Jason W San
(74) *Attorney, Agent, or Firm* — Revolution IP, PLLC

(57) ABSTRACT

Disclosed are an eyelet member and a method of manufacturing the same. The eyelet member includes a first decoration unit, a second decoration unit having at least a portion inserted into the first decoration unit, and a stopper coupled to the first decoration unit and configured to allow the portion of the second decoration unit to pass therethrough, and the stopper is elastically in close contact with the portion of the second decoration unit and fixes the second decoration unit so as to prevent the second decoration unit from moving in a direction opposite an insertion direction thereof.

8 Claims, 11 Drawing Sheets

(51) Int. Cl.

| | |
|---|---|
| ***A44B 13/00*** | (2006.01) |
| ***A45C 13/00*** | (2006.01) |
| ***A45C 13/08*** | (2006.01) |
| ***A45C 13/10*** | (2006.01) |
| *A43C 7/08* | (2006.01) |

(52) U.S. Cl.
CPC ..... *A45C 13/10* (2013.01); *A45C 13/1076* (2013.01); *A43C 7/08* (2013.01); *A44B 13/007* (2013.01)

(56) References Cited

U.S. PATENT DOCUMENTS 2,796,650 A * 6/1957 Van Buren, Jr. ... A44B 17/0082 24/108
2,799,910 A * 7/1957 Weber ..... A44B 17/0082 24/681
2,986,790 A * 6/1961 Silver ..... A44B 17/007 24/379.1
3,088,295 A * 5/1963 Haines ..... A44B 1/04 24/108
3,979,802 A * 9/1976 Bongartz ..... A44B 17/0052 24/630
4,197,617 A * 4/1980 Appelt ..... A44B 1/44 24/114.4
4,253,226 A * 3/1981 Takeda ..... A44B 17/0035 24/691
4,539,735 A * 9/1985 Kasai ..... A44B 17/0029 24/621
4,562,624 A * 1/1986 Kanzaka ..... A44B 17/0029 24/621
4,664,574 A 5/1987 Kasai
4,686,749 A 8/1987 Fukuroi et al.
5,308,671 A * 5/1994 Wells ..... A41B 11/001 2/245
5,685,174 A * 11/1997 Balzer ..... A44B 17/0082 24/578.12
5,933,929 A * 8/1999 Kawakami ..... A44B 17/0035 24/324
6,742,230 B2 * 6/2004 Choi ..... A44B 17/0005 24/691
6,757,945 B2 * 7/2004 Shibuya ..... A47G 27/0418 16/8
6,925,692 B2 * 8/2005 Yang ..... A44B 17/0052 24/681
7,251,865 B2 * 8/2007 Takamura ..... A44B 1/08 24/113 MP
7,945,992 B2 * 5/2011 Parisi ..... B60N 3/046 16/4
8,720,016 B2 * 5/2014 Beaulieu ..... F16B 21/073 24/457
9,517,712 B1 * 12/2016 Masanek, Jr. ..... B60N 3/044
9,839,263 B2 * 12/2017 Villa ..... A44B 17/0023
10,165,811 B2 * 1/2019 O'Leary ..... A41D 27/08
2015/0192156 A1 * 7/2015 Lee ..... F16B 3/00 403/364

FOREIGN PATENT DOCUMENTS

KR 20-0216831 Y1 3/2001
KR 20-2009-0007887 U 8/2009
KR 10-1139106 B1 4/2012

* cited by examiner

【FIG. 1】
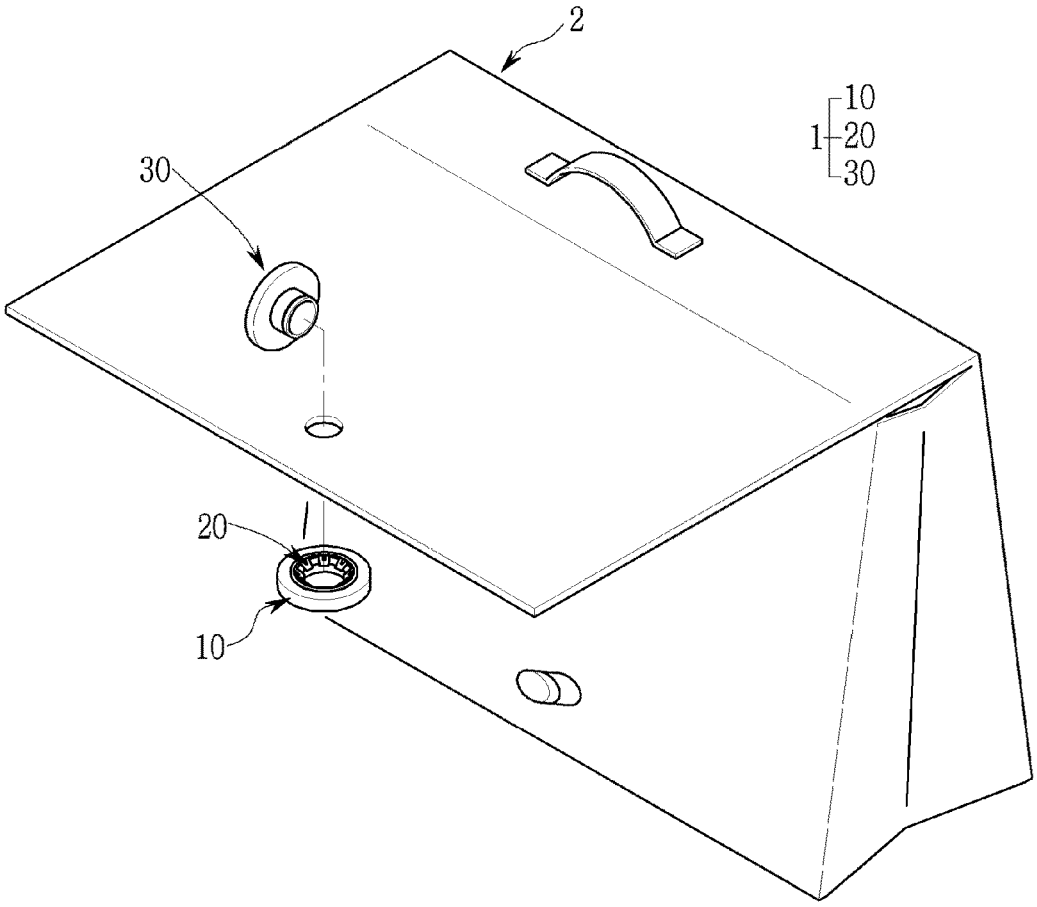

【FIG. 2】
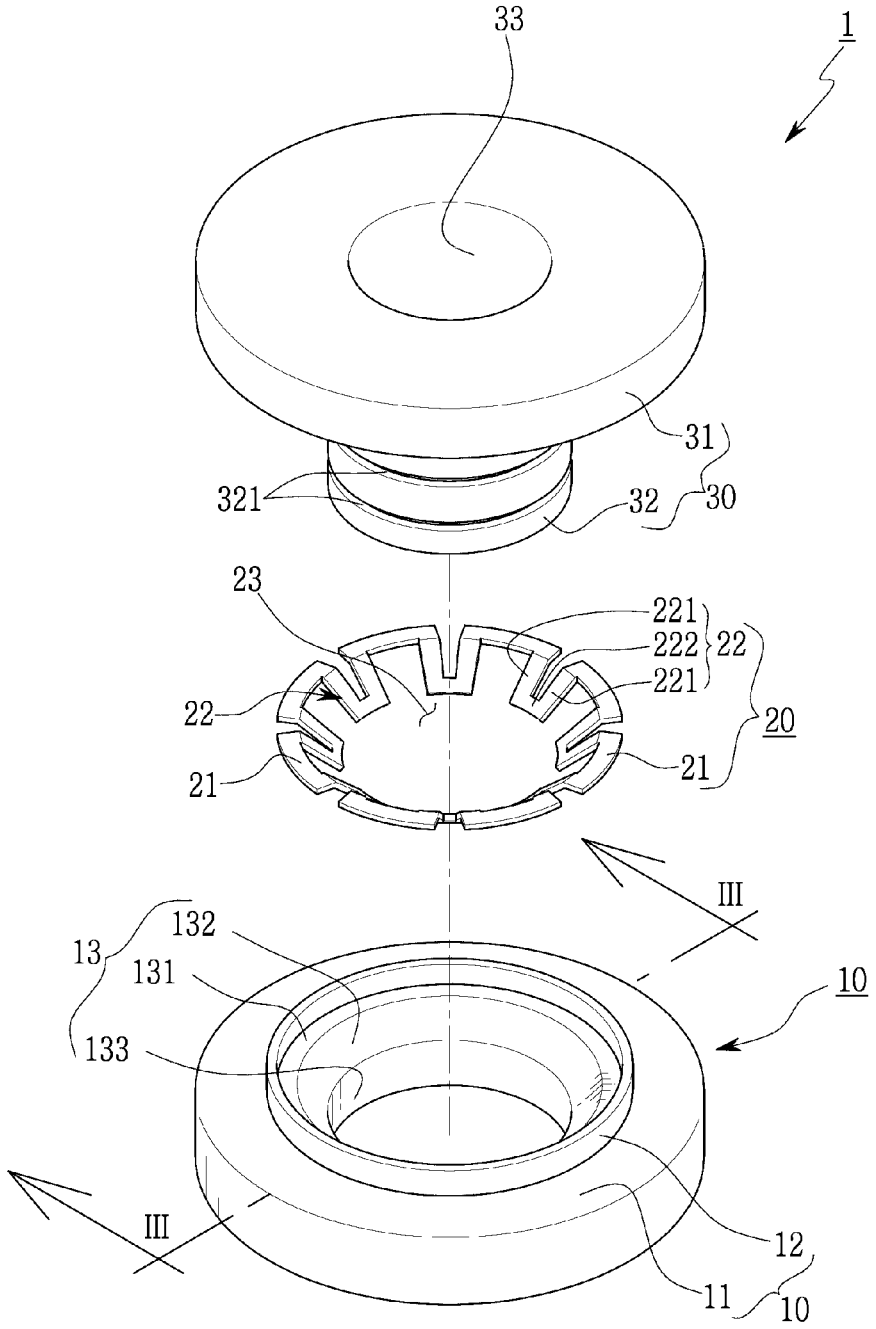

【FIG. 3】
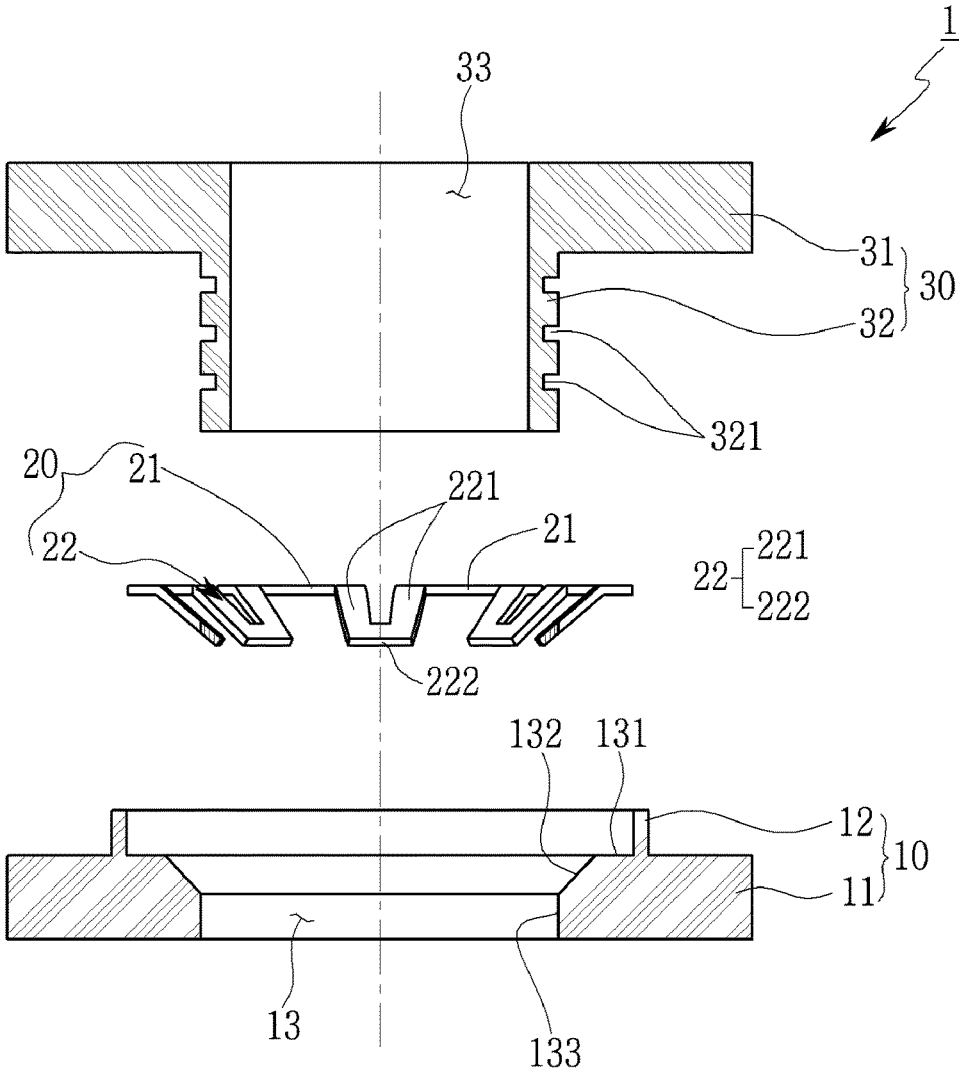

【FIG. 4】
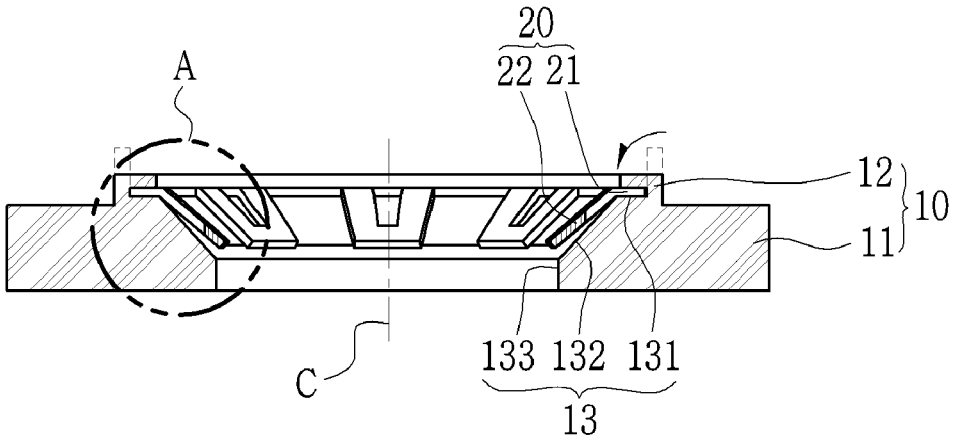

【FIG. 5】
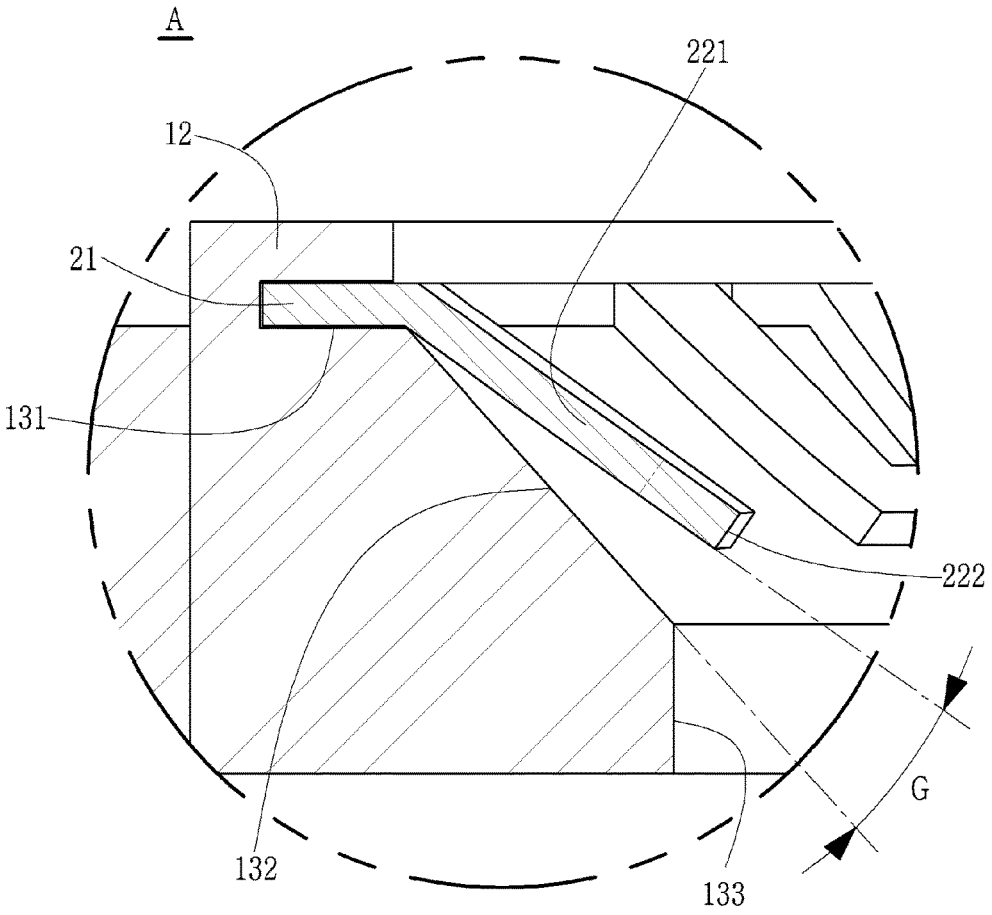

【FIG. 6】
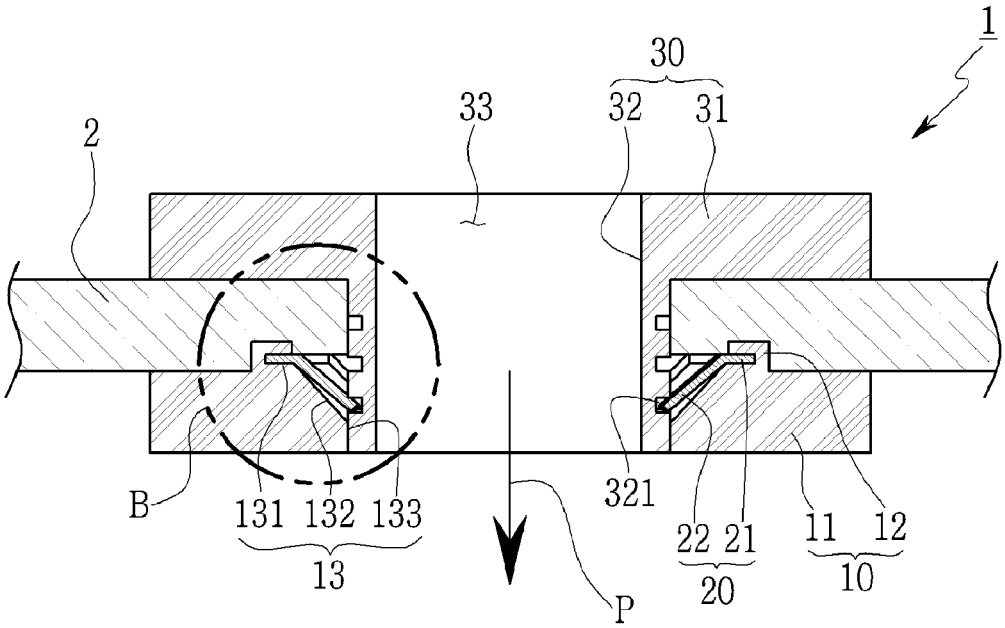

【FIG. 7】
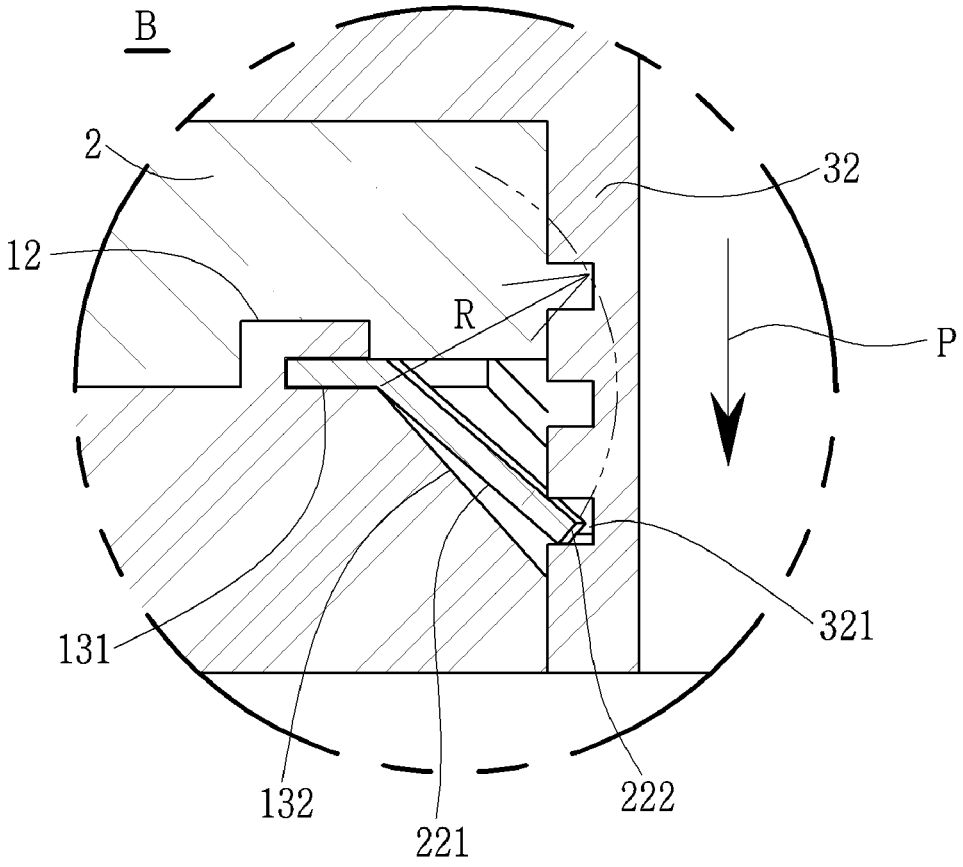

【FIG. 8】
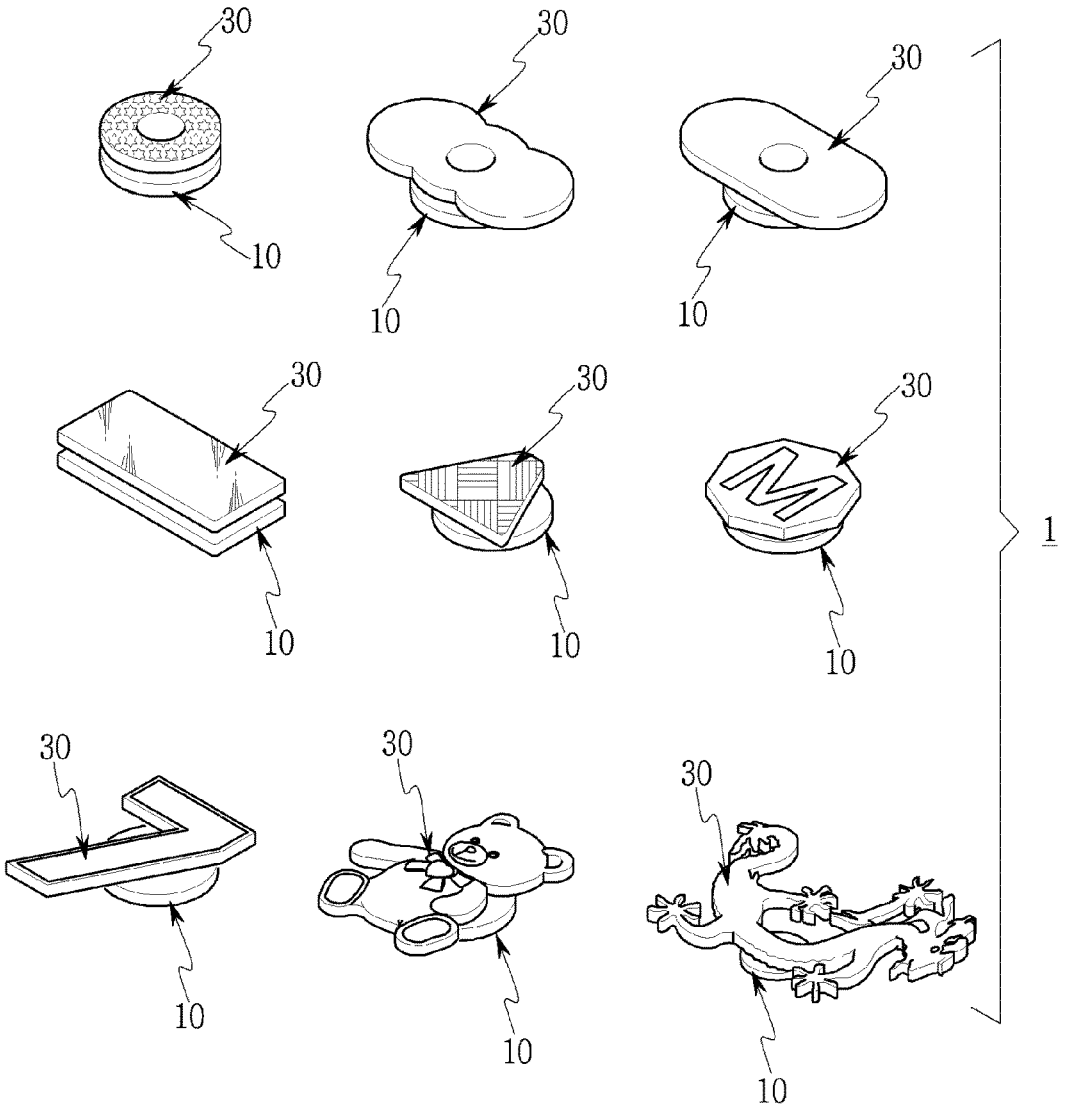

【FIG. 9】
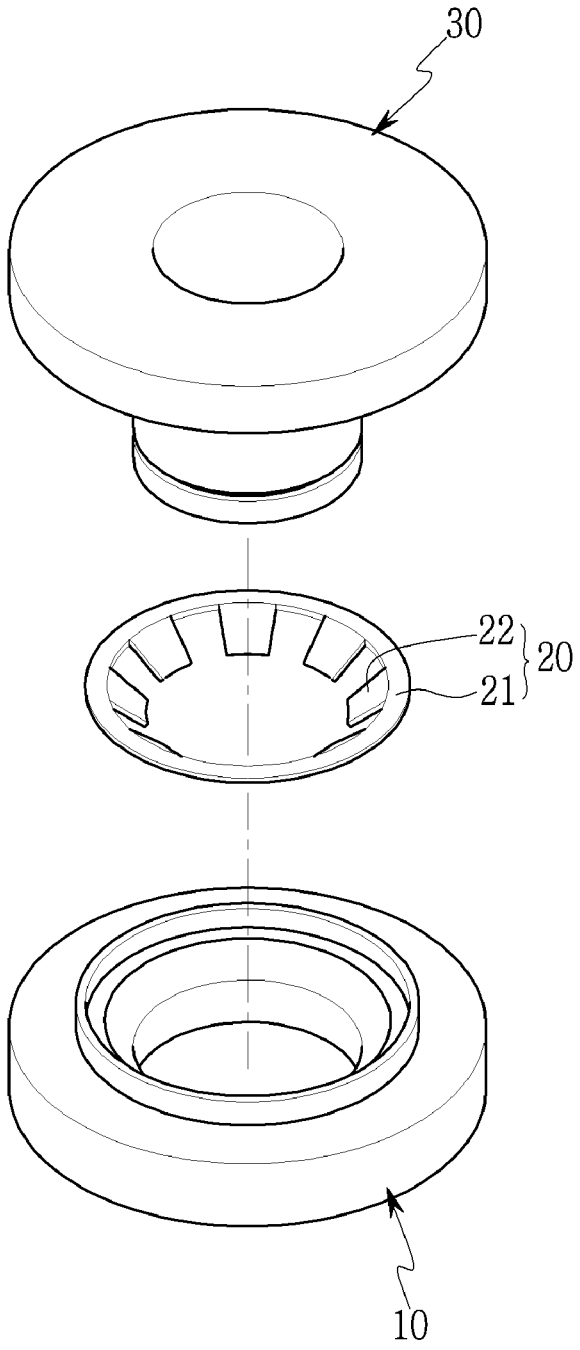

【FIG. 10】
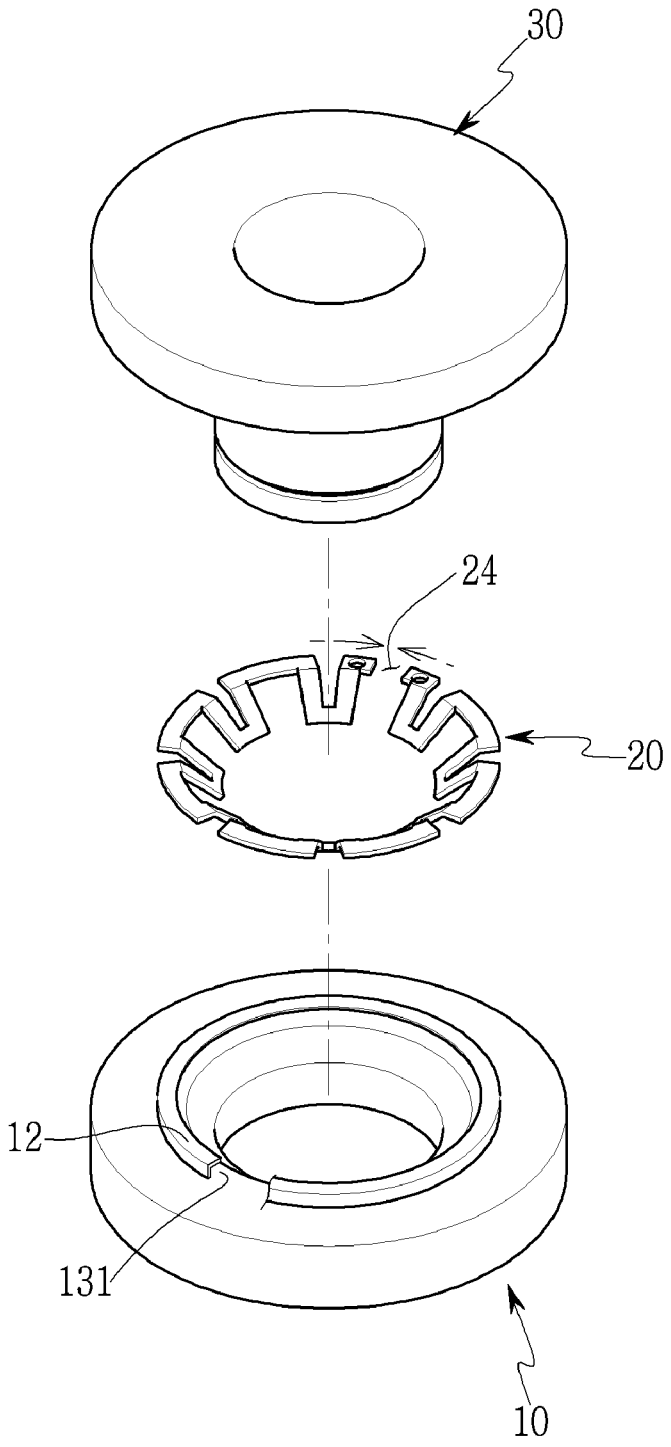

【FIG. 11】
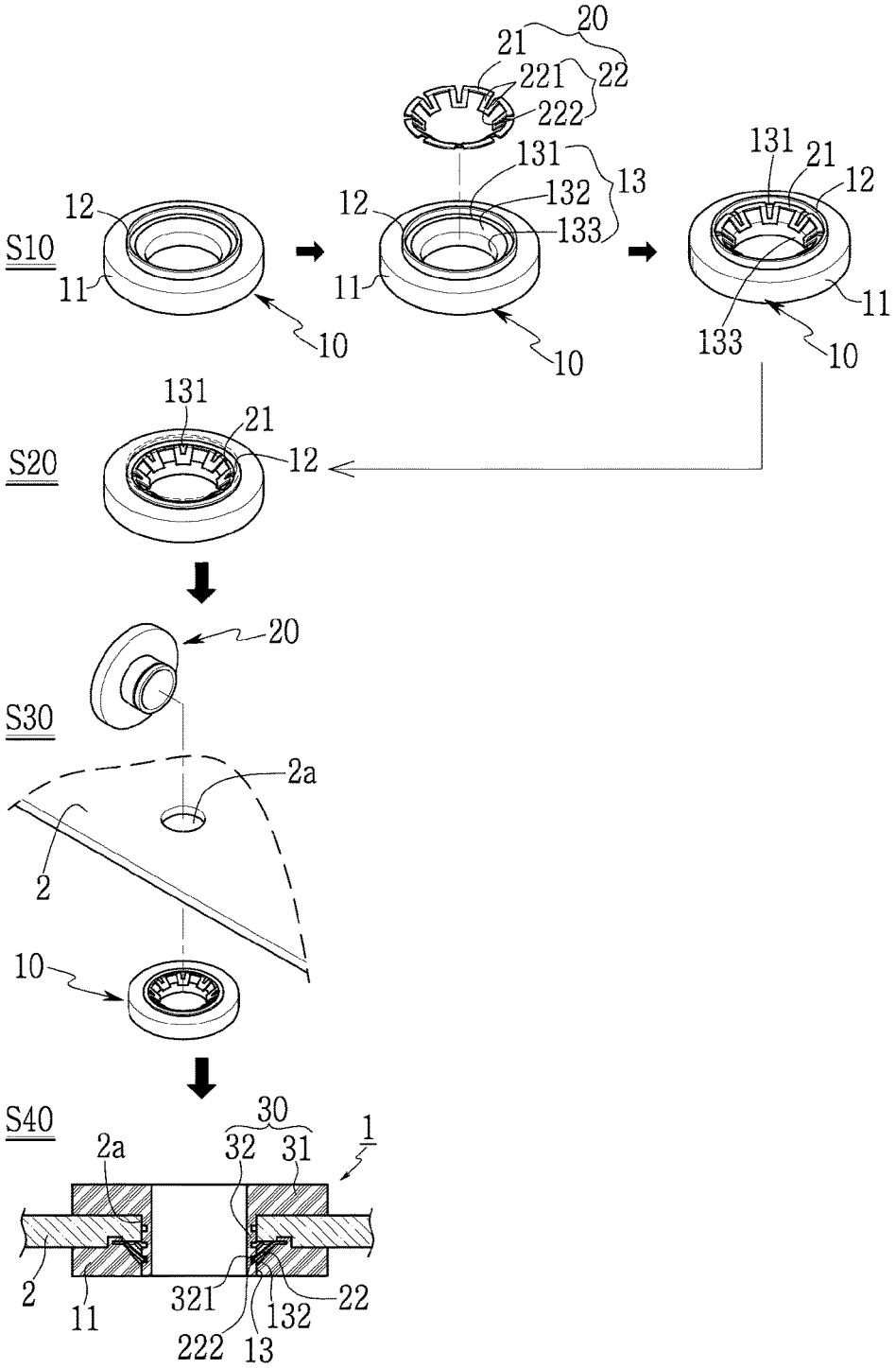

EYELET MEMBER AND METHOD OF MANUFACTURING THE SAME

TECHNICAL FIELD

The present invention relates to an eyelet member and a method of manufacturing the same.

BACKGROUND ART

Handbags, wallets, bags and the like (hereinafter, referred to as portable articles) are equipped with a decorative member such as a brand or emblem tag, an eyelet or a loop for coupling a lace or some other device, and the like (hereinafter, the decorative member, the eyelet, the loop and the like will be referred to as an "eyelet member").

To fix the eyelet member to a portable article, an adhesion method or a physical coupling method is used. The adhesion method causes a phenomenon in which the eyelet member is separated from the portable article after time passes due to the flexible material of the portable article. Meanwhile, the physical coupling method requires additional coupling devices.

DISCLOSURE

Technical Problem

The present invention provides a technology for coupling an eyelet member to a portable article in a simplified manner and for maintaining a coupling force for a long time.

Technical Solution

In accordance with one embodiment of the present invention, an eyelet member includes a first decoration unit, a second decoration unit having at least a portion inserted into the first decoration unit, and a stopper coupled to the first decoration unit and configured to allow the portion of the second decoration unit to pass therethrough, wherein the stopper is elastically in close contact with the portion of the second decoration unit and fixes the second decoration unit so as to prevent the second decoration unit from moving in a direction opposite an insertion direction thereof.

The first decoration unit may include a first body having a positioning hole in which the portion of the second decoration unit is located and a fixing protrusion formed on one surface of the first body to fix the stopper having elasticity, and the positioning hole may be defined by a peripheral surface thereof, and the peripheral surface may include a seating surface configured to support an edge of the stopper and connected to the one surface of the first body, a vertical surface connected to a remaining surface of the first body, and an inclined surface configured to interconnect the seating surface and the vertical surface, the inclined surface defining a gradually decreasing diameter in a direction from the seating surface to the vertical surface.

The stopper may include a plurality of seating members arranged along the seating surface, and a plurality of holding members configured to interconnect the neighboring seating members respectively and to come into close contact with the portion of the second decoration unit.

The second decoration unit may include an insertion member configured to pass through a center of the holding members and located in the positioning hole, and a second body connected to the insertion member.

The insertion member may have at least one holding groove formed in an outer periphery thereof along a circumferential direction so that the holding members are caught in the holding groove.

The holding members may be inclined along the inclined surface, and the holding members may be spaced apart from the inclined surface.

At least a portion of the stopper may be cut off.

The first decoration unit and the second decoration unit may be formed of any one selected from among a group consisting of plastic, metal, wood, acryl, acrylonitrile butadiene styrene (ABS) resin, glass fiber reinforced plastic (FRP), and a combination thereof.

In accordance with another embodiment of the present invention, a method of manufacturing an eyelet member includes disposing a stopper on a first decoration unit having a fixing protrusion, fixing the stopper to the first decoration unit by bending the fixing protrusion, disposing the first decoration unit and a second decoration unit with a portable article interposed therebetween, and coupling the first decoration unit and the second decoration unit to each other, wherein the second decoration unit includes an insertion member that passes through the portable article and the stopper to thereby be located in a positioning hole in the first decoration unit, and the stopper includes a holding member that is brought into contact with an outer peripheral surface of the insertion member.

Advantageous Effects

According to an embodiment of the present invention, a first decoration unit and a second decoration unit are coupled to each other with a portable article interposed therebetween as a holding member is caught in a holding groove formed in an insertion member when the insertion member passes through a through-hole. As such, the first decoration unit and the second decoration unit are assembled in a simplified manner, which enhances productivity.

According to an embodiment of the present invention, the insertion member is not movable in a direction opposite the insertion direction thereof due to the holding member, which is inclined in the insertion direction of the insertion member. As such, the second decoration unit is not separated from the first decoration unit. Accordingly, the coupled state of the first decoration unit and the second decoration unit may be continuously maintained.

DESCRIPTION OF DRAWINGS

FIG. 1 is a perspective view illustrating the state in which an eyelet member according to an embodiment of the present invention is coupled to a portable article;

FIG. 2 is an exploded perspective view of the eyelet member of FIG. 1;

FIG. 3 is a cross-sectional view taken along line III-III of FIG. 2;

FIG. 4 is a cross-sectional view illustrating the coupled state of a stopper and a first decoration unit of FIG. 3;

FIG. 5 is an enlarged view of portion A of FIG. 4;

FIG. 6 is a cross-sectional view illustrating the coupled state of the first decoration unit and a second decoration unit of FIG. 3;

FIG. 7 is an enlarged view of portion B of FIG. 6;

FIG. 8 is a schematic view illustrating various shapes of the first decoration unit and the second decoration unit of FIG. 2;

FIG. 9 is an exploded perspective view of an eyelet member according to another embodiment of the present invention;

FIG. 10 is an exploded perspective view of an eyelet member according to a further embodiment of the present invention; and FIG. 11 is a process view illustrating a method of manufacturing the eyelet member according to the embodiment of the present invention.

| Description of Reference Numerals | |
|---|---|
| 1: eyelet member | 10: first decoration unit |
| 11: first body | 12: fixing protrusion |
| 13: positioning hole | 131: seating surface |
| 132: inclined surface | 133: vertical surface |
| 20: stopper | 21: seating member |
| 22: holding member | 221: protruding piece |
| 222: holding piece | 23: through-hole |
| 30: second decoration unit | 31: second body |
| 32: insertion member | 321: holding groove |
| 33: aperture | |

MODE FOR INVENTION

Hereinafter, embodiments of the present invention will be described in detail with reference to the accompanying drawings in order to allow those of ordinary skill in the art to easily implement the present invention. However, the present invention may be realized in various other forms and is not limited to the embodiments described herein. The same reference numerals will be given to similar elements throughout the specification.

Now, an eyelet member according to an embodiment of the present invention will be described with reference to FIG. 1.

FIG. 1 is a perspective view illustrating the state in which the eyelet member according to the embodiment of the present invention is coupled to a portable article.

Referring to FIG. 1, the eyelet member 1 according to the present embodiment may be disposed at a predetermined position on a portable article 2 and may be used as a decoration member for the portable article, or may be used as a symbolic member (e.g. a brand or emblem tag) that identifies the portable article. The eyelet member 1 may be configured to allow a handle (not illustrated) connected to the portable article or a lace (not illustrate) to pass therethrough, or may be coupled to, for example, a locking member (not illustrated), which is used to fix a cover of the portable article. The eyelet member 1 includes a first decoration unit 10, a stopper 20, and a second decoration unit 30.

The first decoration unit 10 and the second decoration unit 20 are connected to each other with the portable article 2 interposed therebetween. The stopper 20 is coupled to the first decoration unit 10 and serves to prevent the second decoration unit 20 from being separated from the first decoration unit 10. Both the first decoration unit 10 and the second decoration unit 30 may be exposed to the outside of the portable article 2, or only a selected one thereof may be exposed to the outside of the portable article 2. This may differ depending on the shape of the portable article 2 or the position at which the eyelet member is coupled to the portable article 2.

In FIG. 1, the first decoration unit 10 and the second decoration unit 30 are illustrated as having a circular shape, but the first decoration unit 10 and the second decoration unit 30 may have any one of an oval shape, a polygonal shape, an animation character shape, a brand name shape, an emblem shape, and the like, as illustrated in FIG. 8. In addition, a picture, character, symbol or the like may be drawn on the surface of each decoration unit. Here, only the second decoration unit 30, which is exposed to the outside, may be changed in shape and pattern, whereas the first decoration unit 10 may not be changed in shape and pattern.

The shape, pattern, color and the like of the first decoration unit 10 and the second decoration unit 20 may be changed in various ways depending on the design required by the customer and the design of the portable article 2.

The first decoration unit 10 and the second decoration unit 30 may be formed of, for example, metal such as iron, zinc or copper, plastic, wood, acryl, acrylonitrile butadiene styrene (ABS) resin, or glass fiber reinforced plastic. The surfaces of the first decoration unit 10 and the second decoration unit 30 may be plated with various colors. The stopper 20 may be formed of a material having elasticity.

The first decoration unit 10 and the second decoration unit 30 will be described below in more detail with reference to FIGS. 2 to 7.

FIG. 2 is an exploded perspective view of the eyelet member of FIG. 1, FIG. 3 is a cross-sectional view taken along line III-III of FIG. 2, FIG. 4 is a cross-sectional view illustrating the coupled state of the stopper and the first decoration unit of FIG. 3, FIG. 5 is an enlarged view of portion A of FIG. 4, FIG. 6 is a cross-sectional view illustrating the coupled state of the first decoration unit and the second decoration unit of FIG. 3, and FIG. 7 is an enlarged view of portion B of FIG. 6.

First, referring to FIGS. 2 and 3, the first decoration unit 10 includes a first body 11 and a fixing protrusion 12.

The first body 11 defines the external appearance of the first decoration unit 10. The first body 11 may be exposed to the outside of the portable article 2, or may be hidden. The first body 11 is the portion that may be changed in shape, pattern, color or the like depending on the design required by the customer or the design of the portable article.

The first body 11 is centrally provided with a positioning hole 13, both sides of which are open so that a portion of the second decoration unit 10 is located therein. One side of the positioning hole 13 may be closed. A portion of the second decoration unit 30 and the stopper 20 are located in the positioning hole 13. Although FIG. 2 illustrates a positioning hole 13 having a circular shape, the shape of the positioning hole 13 may be changed depending on the shape of the first body 11.

The peripheral surface of the positioning hole 13 is constituted of a seating surface 131, an inclined surface 132, and a vertical surface 133.

The inclined surface 132 is connected to one surface of the first body 11 and defines a gradually decreasing diameter of the positioning hole with decreasing distance from the other surface of the first body 11. The vertical surface 13 interconnects the inclined surface 132 and the other surface of the first body 11. When one side of the positioning hole 13 that is close to the other surface of the first body is closed, the vertical surface 133 is not connected to the other surface of the first body 11.

The seating surface 131 is the portion between the fixing protrusion 12 formed on one surface of the first body 11 and the inclined surface. That is, the seating surface 131 is a portion of one surface of the first body that is connected to the inclined surface 32.

The fixing protrusion 12 is formed into a ring shape and is located on one surface of the first body 11 so as to separate one surface of the first body 11 from the seating surface 131.

The fixing protrusion serves to fix the stopper 20. The fixing protrusion 12 remains in the state in which it vertically protrudes from one surface of the first body 11 before the stopper 20 is fixed. However, when the stopper 20 is fixed, as illustrated in FIGS. 4 and 5, the fixing protrusion is bent toward the center of the positioning hole 13. The bent portion of the fixing protrusion 12 faces the seating surface 131 at a distance therefrom.

The second decoration unit 30 includes a second body 31 and an insertion member 32. The second decoration unit 30 is formed with an aperture 33, into which, for example, a lace, a locking device, or a handle connected to the portable article 2, is coupled. The shape of the aperture 33 may be changed in various ways depending on the shape of the second decoration unit 30. Alternatively, the aperture 33 may be omitted.

The second body 31 defines the external appearance of the second decoration unit 30. The second body 31 may be exposed to the outside of the portable article 2, along with the first body 11. Alternatively, when the first body 11 is hidden, only the second body 31 may be exposed. The second body 31 is the portion that may be changed in shape, pattern, color or the like depending on the design required by the customer or the design of the portable article.

The second body 31 faces the first body 11 at a distance therefrom. The distance between the second body 31 and the first body 11 may be changed depending on the thickness of the portable article 2.

The insertion member 32 vertically protrudes from the second body 31 toward the first body 11. The diameter of the outer peripheral surface of the insertion member 32 is less than the diameter of the second body 31. The end of the insertion member 32 is located on the vertical surface 133 of the positioning hole 13. Because the diameter of the outer peripheral surface of the insertion member 32 is less than the diameter of the positioning hole 13 that is defined by the vertical surface 133, the outer peripheral surface of the insertion member 32 is spaced apart from the vertical surface 133. The insertion member 32 does not protrude outward from the first body 11.

A holding groove 321 is formed in the outer peripheral surface of the insertion member 32. Specifically, a plurality of holding grooves 321 is formed in the longitudinal direction of the insertion member 32 at an interval. Alternatively, only one holding groove 321 may be formed. The number of holding grooves 321 may be changed depending on the length of the insertion member 32 or the thickness of the portion of the portable article 2 that is located between the first body 11 and the second body 31. Alternatively, the holding groove 321 may be omitted.

The shape of the insertion member 32 corresponds to the shape of the positioning hole 13. The insertion member 32 may be formed into a circular shape even if the second body 31 is changed in shape and pattern in various ways.

The stopper 20 has an outer contour corresponding to the shape of the positioning hole 13, and includes seating members 21 and holding members 22.

The seating members 21 are arranged at an interval in the circumferential direction between the seating surface 131 and the fixing protrusion 12. The seating members 21 are fixed when the fixing protrusion 12 is pushed.

The holding members 22 respectively interconnect the neighboring seating members 21 and fix the insertion member 32 so as to prevent movement of the insertion member 32. Each of the holding members 22 includes protruding pieces 221 and a holding piece 222.

The protruding pieces 221 protrude toward the center of the positioning hole 13 from opposite ends of each seating member 21 and are bent along the inclined surface 132. That is, the protruding pieces 221 are bent in the direction in which the insertion member 32 is inserted. A portion of each protruding piece 221 that faces the inclined surface 132 is spaced apart from the inclined surface 132 by a distance G. The protruding piece 221 has elasticity. The protruding piece 221 may be elastically moved toward the inclined surface 132 when the insertion member 32 is inserted (see FIG. 5).

The holding piece 222 interconnects the protruding pieces 221 of the neighboring seating members 21 that face each other. The holding piece 222 is inclined at the same angle as the protruding pieces 221. The plurality of holding pieces 222 of the holding members 22 defines a through-hole 23, through which the insertion member 32 passes, in the center of the stopper 20. The shape of the through-hole 23 corresponds to the shape of the insertion member 32. The diameter of the through-hole 23 is less than the diameter of the outer peripheral surface of the insertion member 32. At least a portion of the holding piece 222 is located in the holding groove 321. When a space margin is reduced due to the use of the portable article 2, the holding piece 222 may be caught in the holding groove 321, which is close to the second body 31, when the second body 31 is pushed toward the portable article 2. The smaller the thickness of the portable article 2, the closer the holding groove 321, in which the holding piece 222 is located, is to the second body 31 (see FIG. 6).

The insertion member 32 is fixed in the positioning hole 13 by the holding piece 222 so as not to move. When the holding groove 321 is omitted, the holding piece 222 is brought into contact with the outer peripheral surface of the insertion member 32. The holding piece 222 is elastically caught by the peripheral surface of the holding groove 321 or the outer peripheral surface of the insertion member 32 by the elasticity of the protruding pieces 221.

When the insertion member 32 tries to move in the direction opposite the insertion direction P within the positioning hole 13, the bent protruding pieces 221 need to bend away from the inclined surface 132, and this bending of the protruding pieces 221 require a rotation radius R. However, the rotation radius R is not secured because the holding piece 222 is caught in the holding groove 321 to thereby be in contact with the insertion member 32. Thus, bending of the protruding piece 221 does not occur and separation of the insertion member 32 from the positioning hole 13 does not occur (see FIG. 7).

Thus, as the holding piece 222 is caught in the holding groove 321 when the insertion member 32 passes through the through-hole 23, the insertion member 32 is fixed inside the first decoration unit 10. This ensures simplified assembly of the first decoration unit 10 and the second decoration unit 30.

Another embodiment of the present invention adopts most of the configuration of the embodiment described above with reference to FIGS. 1 to 8. There is only a difference as to the shape of the stopper 20. Referring to FIG. 9, the stopper 20 according to the present embodiment includes a seating member 21 and holding members 22.

The seating member 21 is formed into a circular shape, is disposed along the seating surface 131, and is fixed by the fixing protrusion 12.

The holding members 22 are formed into a panel shape, protrude toward the center of the positioning hole 13 from the inner peripheral surface of the seating member 21, and are inclined along the inclined surface 132. The holding members 22 are arranged along the inner peripheral surface of the seating member 21. As the end of each holding member 22 is caught in the holding groove 321, the holding members 22 elastically support the insertion member 32 so as to prevent the insertion member 32 from being separated from the positioning hole 13. As for the remainder of the configuration, the configuration of the embodiment of FIGS. 1 to 8 may be directly applied.

A further embodiment of the present invention adopts most of the configurations of the embodiments described above with reference to FIGS. 1 to 9. However, in consideration of the case where the first decoration unit 10 and the second decoration unit 30, which are formed of a resin-based material, are coupled to the stopper 20, as illustrated in FIG. 10, at least a portion of a seating member 21 is cut off. The seating member 21 may be circularly bent inward by a cutoff 24.

When the first decoration unit 10 and the second decoration unit 30 are formed of metal, the fixing protrusion 12 is not bent, but is formed orthogonal to the seating surface 131. Thus, a process of bending the upper side of the fixing protrusion 12 toward the seating member 21 needs to be performed in order to fix the seating member 21 disposed on the seating surface 131. On the other hand, when the first decoration unit 10 and the second decoration unit 30 are formed of a resin-based material, the fixing protrusion 12 is molded into a bent shape. When the seating member 21 is released from a circularly inwardly bent state after the circularly inwardly bent seating member 21 is inserted into the space between the fixing protrusion 12 and the seating surface 131, the seating member 21 spreads and is fixed between the seating surface 131 and the fixing protrusion 12. Thus, when the first decoration unit 10 and the second decoration unit 30 are formed of a resin-based material, production costs may be reduced and the number of assembly processes may be reduced, compared to the case where the first decoration unit and the second decoration unit are formed of metal. As to the remainder of the configuration, the configurations of FIGS. 1 to 9 may be directly applied.

Next, a method of manufacturing the eyelet member according to the present embodiment will be described with reference to FIG. 11.

FIG. 11 is a process view illustrating a method of manufacturing the eyelet member according to the embodiment of the present invention.

The method of manufacturing the eyelet member according to the present embodiment includes a process of disposing the stopper on the first decoration unit (S10), a process of fixing the stopper (S20), a process of disposing the first decoration unit and the second decoration unit with the portable article interposed therebetween (S30), and a process of coupling the first decoration unit and the second decoration unit to each other (S40).

First, when the first decoration unit 10 and the second decoration unit 30 are formed of metal, the fixing protrusion 12 is not bent, but is formed orthogonal to the first body 11.

In the state in which the stopper 20 is located in the positioning hole 13 in the first decoration unit 10, the seating member 21 is disposed on the seating surface 131. The holding member 22 faces the inclined surface 132 at a distance therefrom. The end of the holding piece 222 is located on the vertical surface 133 of the positioning hole 13 (S10).

The upper side of the fixing protrusion 12 is bent toward the seating member 21 so that a portion of the fixing protrusion 12 is brought into contact with the seating member 21. The bent portion of the fixing protrusion 12 pushes the seating member 21 toward the seating surface 131 to thereby fix the seating member 21 (S20).

The first decoration unit 10 and the second decoration unit 30 are disposed such that the portable article 2 is interposed therebetween. The portable article 2 is formed with a hole 2*a*, through which the insertion member 32 passes (S30).

The first decoration unit 10 is disposed on the surface of the portable article 2 and the positioning hole 13 and the hole 2*a* are aligned with each other. Then, the insertion member 32 is inserted through the hole 2*a*. The insertion member 32 is pushed toward the inclined surface of the holding member 22 and the end of the holding piece 222 is brought into contact with the outer peripheral surface of the insertion member 32. The insertion member 32 is continuously inserted until the end of the holding piece 222 is caught in the holding groove 321. Then, the insertion member 32 is no longer inserted. As such, the insertion member 32 is fixedly caught by the stopper 20 (S40).

The first body 11 and the second body 31 are coupled to each other so as to face each other with the portable article interposed therebetween.

A worker at a portable article manufacturing factor may simply assemble the eyelet member 1 by disposing the first decoration unit 10 on one surface of the portable article and coupling the second decoration unit 30 on the other surface of the portable article to the first decoration unit 10 without using additional equipment.

The inclined holding member 22 of the stopper 20 prevents the insertion member 32 from moving in a separation direction thereof. As such, the second decoration unit 30 is not separated from the first decoration unit 10. Thus, the coupled state of the first decoration unit 10 and the second decoration unit 30 may be continuously maintained.

A still further embodiment of the present invention adopts most of the manufacturing method of the embodiment described with reference to FIG. 11. There is a difference, however, in that when the first decoration unit 10 and the second decoration unit 30 are formed of a resin-based material and the fixing protrusion 12 faces the seating surface 131 at a distance, the stopper 20 having the seating member 21 provided with a cutoff is used (see FIG. 10).

When the seating member 21 is released from a circularly inwardly bent state after the circularly inwardly bent seating member 21 is inserted into the space between the fixing protrusion 12 and the seating surface 131, the seating member 21 spreads and is fixed between the seating surface 131 and the fixing protrusion 12. Thus, when the first decoration unit 10 and the second decoration unit 30 are formed of a resin-based material, production costs may be reduced and the number of assembly processes may be reduced, compared to the case where the first decoration unit and the second decoration unit are formed of metal. As for the remainder of the configuration, the manufacturing method of FIG. 11 may be directly applied.

Although the exemplary embodiments of the present invention have been described above in detail, the scope of the present invention is not limited thereto, and various modifications and alterations made by those skilled in the art using the basic concept of the present invention are also included in the scope of the present invention.

INDUSTRIAL APPLICABILITY

The present invention provides a decorative member such as a brand or emblem tag, an eyelet or a loop for coupling a lace or any other device, or the like for handbags, wallets, bags and the like (hereinabove, referred to as a "portable article").

The invention claimed is:

1. An eyelet member comprising:

a first decoration unit;

a second decoration unit having at least a portion inserted into the first decoration unit; and a stopper coupled to the first decoration unit and configured to allow the portion of the second decoration unit to pass therethrough, wherein the stopper is elastically in close contact with the portion of the second decoration unit and fixes the second decoration unit so as to prevent the second decoration unit from moving in a direction opposite an insertion direction thereof, wherein the first decoration unit includes a first body having a positioning hole in which the portion of the second decoration unit is located and a fixing protrusion formed on one surface of the first body to fix the stopper having elasticity, wherein the positioning hole is defined by a peripheral surface thereof, and the peripheral surface includes: a seating surface configured to support an edge of the stopper and connected to the one surface of the first body; a vertical surface connected to a remaining surface of the first body; and an inclined surface configured to interconnect the seating surface and the vertical surface, the inclined surface defining a gradually decreasing diameter in a direction from the seating surface to the vertical surface.

2. The eyelet member according to claim 1, wherein the stopper includes:

a plurality of seating members arranged along the seating surface; and a plurality of holding members configured to interconnect the neighboring seating members respectively and to come into close contact with the portion of the second decoration unit.

3. The eyelet member according to claim 2, wherein the second decoration unit includes:

an insertion member configured to pass through a center of the holding members and located in the positioning hole; and a second body connected to the insertion member.

4. The eyelet member according to claim 3, wherein the insertion member has at least one holding groove formed in an outer periphery thereof along a circumferential direction so that the holding members are caught in the holding groove.

5. The eyelet member according to claim 2, wherein the holding members are inclined along the inclined surface, and the holding members are spaced apart from the inclined surface.

6. The eyelet member according to claim 1, wherein at least a portion of the stopper is cut off.

7. The eyelet member according to claim 1, wherein the first decoration unit and the second decoration unit are formed of any one selected from among a group consisting of plastic, metal, wood, acryl, acrylonitrile butadiene styrene (ABS) resin, glass fiber reinforced plastic (FRP), and a combination thereof.

8. A method of manufacturing an eyelet member, the method comprising:

disposing a stopper on a first decoration unit having a fixing protrusion;

fixing the stopper to the first decoration unit by bending the fixing protrusion;

disposing the first decoration unit and a second decoration unit with a portable article interposed therebetween; and coupling the first decoration unit and the second decoration unit to each other, wherein the second decoration unit includes an insertion member that passes through the portable article and the stopper to thereby be located in a positioning hole in the first decoration unit, and the stopper includes a holding member that is brought into contact with an outer peripheral surface of the insertion member, wherein the first decoration unit includes a first body having a positioning hole in which the portion of the second decoration unit is located and a fixing protrusion formed on one surface of the first body to fix the stopper having elasticity, wherein the positioning hole is defined by a peripheral surface thereof, and the peripheral surface includes: a seating surface configured to support an edge of the stopper and connected to the one surface of the first body; a vertical surface connected to a remaining surface of the first body; and an inclined surface configured to interconnect the seating surface and the vertical surface, the inclined surface defining a gradually decreasing diameter in a direction from the seating surface to the vertical surface.

* * * * *